United States Patent [19]

Dorpmund

[11] 4,169,407

[45] Oct. 2, 1979

[54] SIDE WALL CONSTRUCTION FOR A CONTAINER FOR SHIPPING GOODS

[75] Inventor: Willi Dörpmund, Elze, Fed. Rep. of Germany

[73] Assignee: Graaff Kommanditgesellschaft, Fed. Rep. of Germany

[21] Appl. No.: 844,059

[22] Filed: Oct. 20, 1977

[30] Foreign Application Priority Data

Oct. 27, 1976 [DE] Fed. Rep. of Germany ..... 2648666

[51] Int. Cl.[2] ..... F24F 13/00; B65J 1/02

[52] U.S. Cl. ..... 98/32; 98/52; 220/1.5; 55/444; 98/18

[58] Field of Search ..... 98/6, 8, 18, 32, 42 R, 98/52, 53, 54, 55; 220/1.5, 373, 374; 55/444

[56] References Cited

U.S. PATENT DOCUMENTS

| | | | |
|---|---|---|---|
| 520,675 | 5/1894 | Gindele | 55/444 |
| 648,575 | 5/1900 | Scheiffler | 55/444 |
| 657,743 | 9/1900 | Miller | 98/8 |
| 1,308,737 | 7/1919 | Harrison | 98/8 |
| 1,405,613 | 2/1922 | Milliken | 55/444 |
| 2,885,941 | 5/1959 | Allen | 98/18 |
| 3,647,100 | 3/1972 | Russell-French | 220/1.5 |
| 4,000,827 | 1/1977 | Emery | 220/1.5 |
| 4,122,761 | 10/1978 | Westin et al. | 98/52 |

FOREIGN PATENT DOCUMENTS

| | | | |
|---|---|---|---|
| 79171 | 9/1955 | Netherlands | 98/18 |

*Primary Examiner*—Henry C. Yuen

*Attorney, Agent, or Firm*—McGlew and Tuttle

[57] ABSTRACT

A side wall construction for a container for shipping goods includes upper and lower hollow tubular chords which are interconnected by a side wall portion. Each chord is of substantially rectangular configuration and includes a lower downwardly sloping wall with a bottom opening directly adjacent the downwardly sloping wall in the adjacent wall and with a top opening vertically offset and diagonally opposite the lower opening. The interior of each chord is provided with a plurality of downwardly inclined and oppositely directed sheet metal deflectors. The deflectors advantageously extend inwardly from respective opposite walls and the clearance between the end of the deflector with the adjacent opposite wall is smaller than the cross-section of the openings in the chords.

7 Claims, 1 Drawing Figure

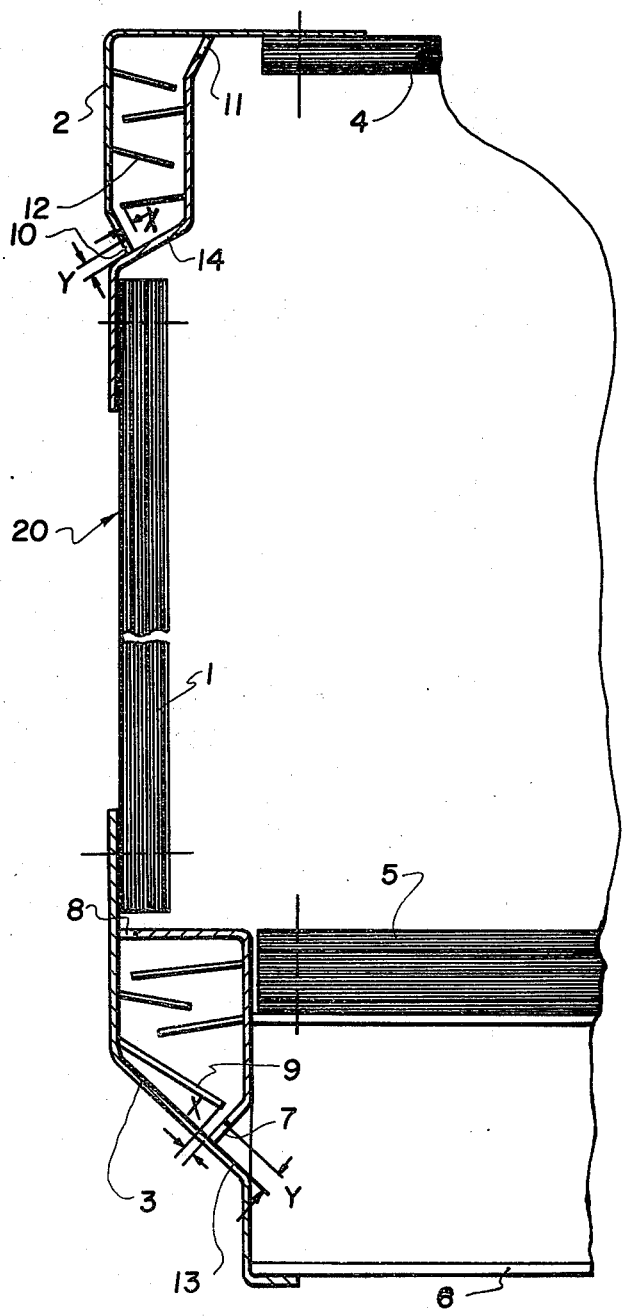
2
11
4
12
10
14
Y
20
1
5
8
9
7
3
Y
13
6

SIDE WALL CONSTRUCTION FOR A CONTAINER FOR SHIPPING GOODS

FIELD AND BACKGROUND OF THE INVENTION

This invention relates in general to container construction and, in particular, to a new and useful side wall of a container for the shipment of goods, in which the upper and lower chords are designed as hollow girders and are provided with openings for ventilating the goods being shipped.

DESCRIPTION OF THE PRIOR ART

The covering of the vent openings of containers with a ventilation grating comprising a plurality of equal-sided angle irons, the sides of which project above the side wall, is well known. A skirting air current, deflected away from the ventilation grating and an underpressure is thereby produced within the grating by which air is taken out from the interior of the container. The underpressure increases with the traveling speed. Because of the occurring underpressure in the grating, such a ventilation grating is unsuitable for supplying air into the container.

A further ventilation grating is known in which a frame with a double row of vertically extending bars is provided which are staggered and have V-shape cross-sections, with the open angles of the bars facing each other and their legs overlapping. Such ventilation gratings are capable of precipitating rain water and dust taken in with the air, but they have the disadvantage that only a limited zone behind the grating is ventilated, so that it is necessary to provide at least two rows of gratings over the entire length of the side wall, whereby, the bearing strength of the side wall is weakened and the containers can no longer be stacked. Since the bars are arranged in double rows, the ventilation gratings have a cross-section which is considerably larger than that of the side wall, with the bars projecting above the outer and inner surfaces of the side wall which results in damaging by the goods being shipped or by the adjacent containers during stacking.

SUMMARY OF THE INVENTION

The present invention is directed to the elimination of such drawbacks and to a system of ventilation suitable for a side wall of the kind mentioned above, which is effective over the entire length of the side wall and which positively produces an air stream through the entire interior of the container.

In accordance with the invention, the upper and lower chords of the container are provided with a plurality of horizontal openings which are offset relative to and diagonally opposed to each other, and downwardly inclined, oppositely directed, sheet-metal deflectors are provided in the upper and lower chords, between the openings.

Accordingly, it is an object of the invention to provide a side wall construction for a container for shipping goods which comprises a side wall having upper and lower hollow tubular chords, each chord having a plurality of openings which are vertically offset and diagonally oppositely located relative to each other, and a plurality of downwardly inclined and oppositely directed deflectors within each upper and lower chord disposed between the openings of respective ones of said chords.

A further object of the invention is to provide a side wall construction for a container for shipping goods which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which a preferred embodiment of the invention is illustrated.

BRIEF DESCRIPTION OF THE DRAWING

The only FIGURE of the drawing is a partial sectional view of a container constructed in accordance with the invention.

DESCRIPTION OF THE PREFERRED EMBODIMENT

Referring to the drawing in particular, the invention embodied therein, comprises a side wall for a container, generally designated 20, of which portions of the side, top and bottom walls are shown. Side wall 1 is mounted between an upper chord 2 and a lower chord 3 with a container roof 4 which is connected to the upper chord 2 and a container bottom 5 connected to the lower chord 3. The lower chord 3 is supported on a cross-beam 6. Lower chord 3 is provided, on the one hand, with a plurality of horizontal openings 7 which are advantageously located in the lowermost portion of chord 3, at the inside adjacent the cross-beam 6 and, on the other hand, with a plurality of horizontal openings 8 leading into the interior of the container which are advantageously protected against the goods being shipped by the lower edge of side wall 1 spaced apart therefrom.

Substantially horizontal deflectors 9 are provided between openings 7 and 8, within lower chord 3, with the deflectors being inclined in the direction toward openings 7 and they alternately extend from the opposite vertical walls of the chord. The clearance X between deflectors 9 and the opposite wall of lower chord 3 is smaller than the cross-section Y of openings 7 and 8. In this connection, it is most important to ensure a uniform air velocity over the entire take-in cross-sectional area to avoid undesirable ramming pressures and also to obtain a complete separation of the rain water and dust taken in with the air.

Upper chord 2 is provided with outwardly directed horizontal openings 10 in its lowermost portion and, in its uppermost portion, it is provided with horizontal openings 11 which lead into the interior of the container and have the same cross-section Y. Substantially horizontal sheetmetal deflectors 12 are provided between openings 10 and 11 within upper chord 2, which extend alternately in opposite directions. Upper chord 2 is advantageously recessed in the zone of openings 10. At least the clearance X between the deflector 12 closest to opening 10 and the opposite wall of chord 2 is smaller than cross-section Y of opening 10, whereby, an air scoop is formed between the lowermost deflector 12 and bottom wall 14 of chord 2 to separate rain water and dust.

The ventilation functions as follows: An air current skirting the side wall of a container in motion is cut by the edges of openings 7 and heavy foreign bodies which might be entrained by the air current are ejected. The air stream is prevented from being conducted away because it is conveyed, so to speak as if in a duct, through cross-beam 6 extending in spaced relationship to openings 7. Foreign bodies which have not been separated from the air current pass to the lowermost portion of deflectors 9 where the air current is deflected.

As the foreign bodies impinge on this deflector, their speed is reduced to such an extent that they drop off and slide along bottom wall 13 of chord 3 which is inclined toward openings 7, and drop out from lower chord 3. Rain water and snow remain below the lowermost deflector and on bottom wall 13 and migrate out downwardly. The deflected air current now passes to the following deflectors. The remaining foreign bodies are thereby separated in the same manner as above and pass through openings 7 to the outside. The air current thus purified passes through openings 8 into the interior of the container where it produces an excess pressure.

The air current skirting upper chord 2 passes openings 10, whereby, an underpressure is produced removing air from upper chord 2 and, consequently, from the interior of the container, by suction. Foreign bodies which are taken in through the opening by small partial streams of the air current impinge against the lowermost portion of deflectors 12 and drop out in the above described manner, due to bottom wall 14 which is inclined toward openings 10. Since the inventive ventilating arrangement produces an excess pressure in the lower part of the interior of the container and an underpressure in the upper part thereof, a uniform ventilation of the container is obtained by the pressure equalization.

While a specific embodiment of the invention has been shown and described in detail to illustrate the application of the principles of the invention, it will be understood that the invention may be embodied otherwise without departing from such principles.

What is claimed is:

1. A side wall construction for a container for shipping goods, comprising a side wall having upper and lower hollow tubular chords, each having a plurality of openings which are vertically offset and diagonally oppositely located relative to each other, and a plurality of downwardly inclined and oppositely directed deflectors within each of said upper and lower chords disposed between the openings of respective ones of said chords, a bottom connected to said lower chord having a cross-beam, said lower chord having a lowermost opening directed toward said cross-beam and an uppermost opening leading to the interior of said container.

2. A side wall construction for a container for shipping goods, comprising a side wall having upper and lower hollow tubular chords, each having a plurality of openings which are vertically offset and diagonally oppositely located relative to each other, and a plurality of downwardly inclined and oppositely directed deflectors within each of said upper and lower chords disposed between the openings of respective ones of said chords, each of said chords being of substantially rectangular construction and including a lowermost wall, said upper chord lowermost wall being sloped downwardly and outwardly to the exterior of the wall and having an opening in said chord directly over said lowermost wall, said lower chord having a lowermost wall sloping downwardly to the bottom of said container having an opening directly above said lowermost wall.

3. A side wall construction for a container for shipping goods, comprising a side wall having upper and lower hollow tubular chords, each having a plurality of openings which are vertically offset and diagonally oppositely located relative to each other, and a plurality of downwardly inclined and oppositely directed deflectors within each of said upper and lower chords disposed between the openings of respective ones of said chords, said upper lower chords being of rectangular configuration and each including a plurality of said deflectors extending alternately outwardly from respective opposite side walls thereof, said upper chord having a lowermost wall sloping outwardly and said lower chord having a lowermost wall sloping inwardly with one of the openings of said upper chord being directly over said lowermost wall of said upper chord and one of the openings of said lower chord being directly over the lowermost wall of said lower chord.

4. A side wall according to claim 1, wherein said lower chord deflectors have one end secured to a wall of said deflector and an opposite end defining a clearance between the deflector and adjacent opposite wall which is smaller than the cross-section of the openings in said chord.

5. A side wall construction according to claim 1, wherein said upper chord includes a lowermost opening which is directed outwardly and an uppermost opening which is adapted to connect into the interior of the container.

6. A container for shipping goods, comprising wall means including at least one side wall having a substantially vertical wall portion, an upper tubular cord connected to the top of said substantially vertical wall portion and having a downwardly and exteriorly sloping bottom wall portion and having a top inlet opening adjacent the top of said upper tubular chord opening into the interior of said container and a bottom outlet opening adjacent the bottom of said upper chord opening to the exterior of said container over said sloping bottom wall portion, and a bottom tubular chord having a downwardly and exteriorly extending bottom chord wall portion, and having a top inlet opening adjacent the top of said bottom tubular chord opening into the interior of said container and a bottom outlet opening adjacent the bottom of said bottom tubular chord opening into the interior of said container, and a plurality of downwardly inclined and outwardly directed deflectors within each of said top and bottom chords disposed between the inlet and outlet openings thereof and defining a tortuous air flow path through each of said cords.

7. A container according to claim 6, wherein said upper tubular chord includes a top wall portion extending substantially horizontally and connected to the top of said container, said bottom tubular chord including a substantially horizontally extending portion connected to the bottom of said container.

* * * * *